US005718565A

United States Patent [19]

Kuhn et al.

[11] Patent Number: 5,718,565

[45] Date of Patent: Feb. 17, 1998

[54] APPARATUS AND PROCESS FOR OPERATING A DRY-COMPRESSION VACUUM PUMP

[75] Inventors: Monika Kuhn; Hartmut Kriehn, both of Köln; Rudolf Bahnen, Roetgen, all of Germany

[73] Assignee: Leybold Aktiengesellschaft, Germany

[21] Appl. No.: 411,826

[22] PCT Filed: Aug. 9, 1993

[86] PCT No.: PCT/EP93/02116

§ 371 Date: Apr. 12, 1995

§ 102(e) Date: Apr. 12, 1995

[87] PCT Pub. No.: WO94/09275

PCT Pub. Date: Apr. 28, 1994

[30] Foreign Application Priority Data

Oct. 12, 1992 [DE] Germany ..... 42 34 169.8

[51] Int. Cl.[6] ..... F04B 49/00

[52] U.S. Cl. ..... 417/44.3; 417/53; 417/63

[58] Field of Search ..... 417/18, 19, 32, 417/45, 44.2, 44.11, 205, 42, 43, 53, 63, 247, 366, 410.3, 423.4; 418/9

[56] References Cited

U.S. PATENT DOCUMENTS 3,910,040 10/1975 Garcea ..... 60/277
5,091,686 2/1992 Baik ..... 318/798
5,329,465 7/1994 Arcella et al. ..... 364/551.01
5,356,275 10/1994 Brenner et al. ..... 418/9
5,475,619 12/1995 Sugano et al. ..... 364/558

FOREIGN PATENT DOCUMENTS 472933 3/1992 European Pat. Off. .
476631 3/1992 European Pat. Off. .
1195368 6/1970 United Kingdom .

OTHER PUBLICATIONS

Patent Abstracts of Japan, vol. 9, No. 316(M-438) (2039) 12 Dec. 1985 & JP.A.60 150 491 (Ebara Seisakusho K.K.) 8 Aug. 1985.

*Primary Examiner*—Charles G. Freay
*Assistant Examiner*—Xuan M. Thai
*Attorney, Agent, or Firm*—Wall Marjama & Bilinski

[57] ABSTRACT

A process for operating a dry-compression vacuum pump with at least one pump chamber and at least one rotor driven by an electric motor, and to a vacuum pump suitable for this operating process. To reduce operational shutdowns for maintenance purposes without any risk to the pump, it is proposed that application-specific phenomena leading to deviations from the normal operating status or their effects be monitored and, after a predetermined deviation quantity has been attained at which operation of the vacuum pump could be adversely affected in future, steps be taken to remove the causes thereof.

2 Claims, 1 Drawing Sheet

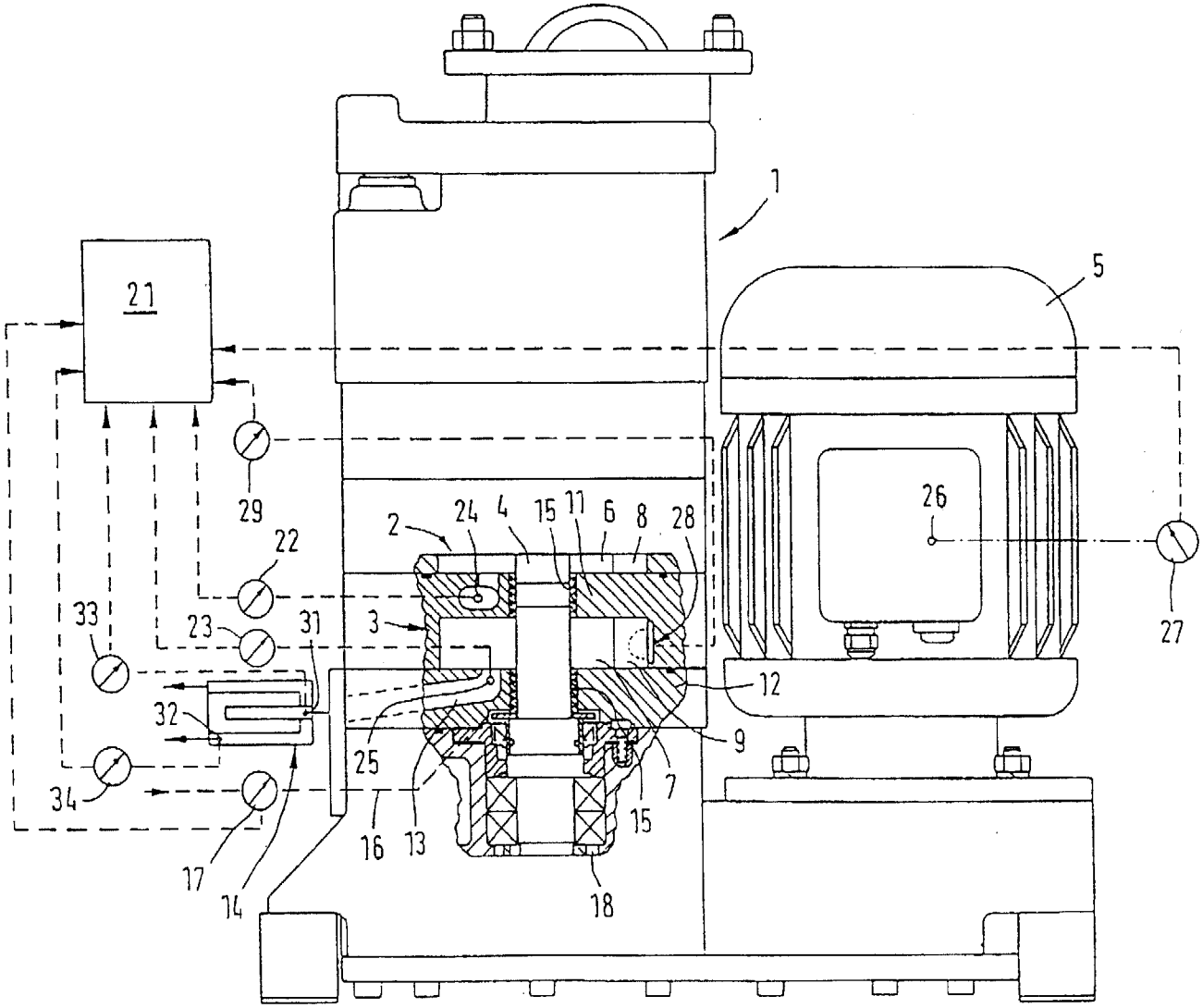
1
2
3
4
5
6
7
8
9
11
12
13
14
15
15
16
17
18
21
22
23
24
25
26
27
28
29
31
32
33
34

APPARATUS AND PROCESS FOR OPERATING A DRY-COMPRESSION VACUUM PUMP

BACKGROUND OF THE INVENTION

1. Field of the Invention

This invention relates to a process for operating a dry-compression vacuum pump.

2. Discussion of the Related Art

Dry-compression vacuum pumps are pumps which have oil-free pump chambers. The advantage offered by these pumps is that they are capable of generating a vacuum which is free of hydrocarbons. Therefore, they are preferably employed for the evacuation of chambers in which etching, coating or other vacuum treatment or vacuum production processes are run. In particular Roots pumps or multi-stage claws pumps are well-proven in practice as dry-compression pumps, i.e., dual shaft vacuum pumps having one or several stages. A pair of rotors is located within each stage. The rotating motion with respect to the rotors themselves and with respect to the walls of the pump chamber is such that no contact is established.

When employing dry-compression pumps in connection with the processes mentioned above, or also for evacuation of vacuum chambers in which chemical processes are run, it is often the case that—depending on the type of application—solids or liquids enter the pump. As long as these are only pumped through the pump, they will hardly impair operation of the pump. However, generally these substances are chemically aggressive or at least chemically or physically reactive, so that these may cause abrasions (in the case of liquids, for example) or formation of layers (in particular, when dust is in involved). In both cases there exists the danger of reduced service life for the vacuum pump. In the presence of aggressive liquids, wear effects are increased. The danger of dust exists in particular when the pumping semiconductor process gases. In this kind of application the circumstances may be such that extremely fine solid particles may be formed during the compression phase of the gases, i.e. when the gases which are to be removed pass through the vacuum pump. Solid particles which enter the vacuum pump either directly or indirectly may deposit themselves in the pump chamber, where they at first only cause a narrowing of the slit between the rotors. Further deposits may cause the rotors to touch, so that the solid particles are rolled on to the surfaces of the rotors. When the deposits increase further, then the layer which is rolled on to the rotors thickens, so that a force is created which forces the rotors and thus the shafts of the rotors apart. In particular, when the rolled on layer increases further, this will damage the bearings and result in a failure of the pump.

For the reasons described, dry-compression vacuum pumps which are employed in connection with the applications described, are, for safety reasons, subjected to frequent maintenance, and this not only with the aim of preventing a reduction of service life, but also to prevent operational shutdowns due to malfunctions in the operation of the vacuum pump. However, operational shutdowns will also be required for necessary maintenance work, so that one none the less tries to make the intervals between servicing not all too short.

OBJECTS AND SUMMARY IF THE INVENTION

The present invention is based on the task of reducing operational shutdowns which are necessary for maintenance work on dry-compression pumps, but without increasing the risk of reduced service life or the risk of operational shutdowns due to malfunctioning dry-compression vacuum pumps.

According to the present invention this task is solved by monitoring application-specific phenomena or their effects which lead to deviations from the normal operating status and ensure, that after a predetermined deviation quantity has been attained which makes apparent that in future operation of the vacuum pump might be adversely affected, measures can be introduced to remove the causes thereof. The main advantage of this proposal is that unnecessarily frequent shutdowns due to maintenance work can be avoided. Functioning of the pump is monitored constantly. Signs of imminent failures in the operation can be determined in due time. Thus there then exists the possibility of extending the intervals between servicing until the danger of operational failures is indicated. Since the time until such an indication occurs differs from application to application, the intervals between servicing can be optimally adapted to each application.

BRIEF DESCRIPTION OF THE DRAWING

Further advantages and details of the present invention shall be explained by referring to the drawing, wherein.

FIG. 1 is a partially broken away,side elevation view of a multi-stage claws pump illustrating the method of the present invention.

DETAILED DESCRIPTION OF THE INVENTION

Shown in the drawing figure is a view of a multi-stage claws pump 1, as it is known from EU-A-365 695, for example. The last two stages 2 and 3 are shown cut open at the level of one of the two shafts 4. The shafts are driven with the aid of drive motor 5 via gear wheels which are not shown, and which also ensure synchronisation of shafts 4 and rotor pairs 6, 7 in stages 2, 3. Rotor pairs 6, 7 are located in pump chambers 8, 9 which are separated by side shields 11 (of which one is visible). The last stage 3 is formed by side shield 11 and an exhaust disc 12 which is located in exhaust channel 13. The gases which are pumped through pump 1 and which are ejected out of the last stage 3 enter through exhaust channel 13 into a silencer 14 and from there they are released into the open, possibly after having been cleaned.

Shafts 4 penetrate side shields 11 and exhaust disc 12. Labyrinth seals 15 are provided at the level of the penetrations. Moreover, it is shown schematically that labyrinth seals 15 are equipped with a "purge seal" between shafts 4 and exhaust disc 12. For this, an inert gas, preferably nitrogen—is admitted into the respective space under the labyrinth seal 15 via line 16 with gas rate monitor 17. A steady flow of inert gas is maintained in the direction of pump chamber 9 via labyrinth seals 15 and the slit between the corresponding rotor 7 and the related wall of the pump chamber. This prevents the entry of harmful substances from the gases pumped by claws pump 1 into the bearing and gear space 18 located under the exhaust disc 12.

In order to be able to monitor operation of the claws pump 1 shown with respect to deviations from normal operation due to the application, several alternatives are shown schematically which may be employed individually, in multiples or also together. In all alternatives, typical operating parameters which may change due to process induced phenomena are monitored. The signals detected by the measuring instruments are supplied to a recording and display stage 21. It is the task of this stage to initially indicate or provide a warning signal. This signal is provided at a point of time where the determined application related phenomena have not already led to a malfunction in the operation of the pump. The causes for later malfunctions can be removed after this warning signal has been issued. If the warning signal is ignored, it will then be advantageous to generate an alarm signal when the quantity which deviates increases further. This will then signal that it is now urgently required to remove the causes for possible malfunctions; another possibility might be to shut down pump 1 as soon as the alarm level is attained.

Monitoring the formation of layers within a stage of pump 1 may be based on different indicators. For example, it is typical of a dry-compression pump that the pressure ratio across the stages is, among other things—dependant on the return flow loss in the slit seals. When deposits form in these slits, play is reduced so that, initially, the compression ratio increases, i.e., the characteristics of the pump improve. Thus the pressure ratio of a stage running at ultimate pressure or in the presence of a flow may be used as an indicator. The pressure ratio is measured by pressure gauges 22, 23, the sensors 24, 25 of which are located in the inlet or the exhaust, respectively, of the stages which are to be monitored (stage 3 in the case of the design example shown in the drawing figure). As the formation of deposits progresses, the pressure ratio (inlet pressure divided by exhaust pressure) increases. It will be required to empirically determine at which pressure ratio levels the warning and the alarm signal will have to be issued. Also, monitoring of the improving ultimate pressure alone permits conclusions to be drawn as to the formation of deposits in the pump chambers and on the rotors. However, for this it would have to be necessary to separate the pump from the vacuum chamber in which the process takes place.

Moreover, deposits and thus less play in the pump chambers lead to fluctuating motor currents. An increase in these fluctuations will therefore point in the direction of increasing deposits and may be employed for detection purposes. In the design example provided, this alternative is indicated by sensor 26 which is related to drive motor 5 and ammeter 27, the signal of which is supplied to recording and display stage 21.

Deposits may also block exhaust channel 13 and/or the silencer 14. If effects of this kind occur, then these can be detected relatively early by observing the power consumption of drive motor 5, i.e., by observing the motor current with the aid of ammeter 27. There is the further possibility of being able to detect these effects at an early stage through pressure measurements (pressure drop in the silencer with the aid of pressure sensors 31, 32 and measuring instruments 33, 34, observation of the exhaust pressure with the aid of measuring instrument 23). In order to determine a beginning blockage of the silencer, it might be sufficient to monitor the pressure in its inlet area (pressure sensor 31) alone. However, it will be of greater reliability to determine the pressure drop, whereby two pressure sensors 31 and 32 are required.

Moreover, there exists the possibility of being able to capacitively detect deposits. For this purpose the electrodes of a capacitor 28 are integrated into the wall of the pump chamber (pump chamber 9, in the design example shown). Deposits will cause the capacitance which is measured with the aid of measuring instrument 29 to change.

Besides this, there exists the possibility of being able to determine the formation of deposits based on the inert gas rate which is determined by measuring instrument 17. The formation of deposits will reduce the amount of flowing inert gas per unit of time.

Finally, overloading the pump 1 with particles or liquids may also cause the motor current to increase or fluctuate. With respect to these effects, here too, monitoring of the motor current or its uniformity may be utilised for early detection of malfunctions.

While this invention has been described in detail with reference to a certain preferred embodiment, it should be appreciated that the present invention is not limited to that precise embodiment. Rather, in view of the present disclosure which describes the best mode for practicing the invention, many modifications and variations would present themselves to those of skill in the art without departing from the scope and spirit of this invention, as defined in the following claims.

We claim:

1. A method for monitoring deposition formation in a suction chamber of a dry-sealing vacuum pump, said pump being connected to a vacuum chamber in which a process occurs, said pump having at least one rotor and being driven by an electric motor, the method comprising the steps of:

integrating a capacitor into a wall of said suction chamber;

monitoring a variance of capacitance of said capacitor;

comparing said variance to a threshold value; and generating a warning signal if said variance exceeds said threshold value.

2. A dry sealing vacuum pump, said pump being connected to a vacuum chamber in which a process occurs, said pump having a suction chamber, said pump having at least one rotor and being driven by an electric motor, said pump comprising:

means for integrating a capacitor into a wall of said suction chamber;

monitoring means for monitoring a variance of capacitance of said capacitor;

comparing means, connected to said monitoring means, for comparing said variance to a threshold value; and means, connected to said comparing means, for generating a warning signal if said variance exceeds said threshold value, therein indicating deposition formation in said suction chamber.

* * * * *